US006076360A

United States Patent [19]

Viegas et al.

[11] Patent Number: 6,076,360

[45] Date of Patent: Jun. 20, 2000

[54] CONTROL METHOD FOR A CRYOGENIC UNIT

[75] Inventors: Herman H. Viegas, Bloomington, Minn.; Bradley G. Ellingson, Lisbon, N. Dak.; Mark J. Buenz, Savage, Minn.

[73] Assignee: Thermo King Corporation, Minneapolis, Minn.

[21] Appl. No.: 09/113,855

[22] Filed: Jul. 10, 1998

[51] Int. Cl.[7] ..... F17C 9/02

[52] U.S. Cl. ..... 62/50.2

[58] Field of Search ..... 62/50.1, 50.2, 62/50.3

[56] References Cited

U.S. PATENT DOCUMENTS

| | | | |
|---|---|---|---|
| 3,058,317 | 10/1962 | Putman | 62/50.2 |
| 3,121,999 | 2/1964 | Kasbohm et al. | 62/50.3 |
| 3,552,134 | 1/1971 | Arenson | 62/50.2 |
| 5,285,644 | 2/1994 | Roehrich et al. | 62/50.3 |
| 5,365,744 | 11/1994 | Viegas et al. | 62/50.3 |
| 5,598,709 | 2/1997 | Viegas et al. | 62/50.2 |

*Primary Examiner*—Ronald Capossela
*Attorney, Agent, or Firm*—Wayne Siverton; Michael M. Gnibus

[57] ABSTRACT

Apparatus and methods for improving efficiency of a temperature conditioning system which employs a cryogenic liquid. A vapor powered ventilation motor is normally powered by vapor from the low pressure end of the evaporation coils. However, supplemental vapor is provided at start-up to provide immediate ventilation. In addition, vapor which bleeds off valves is cycled through the vapor powered motor or used to maintain a slight positive pressure when the system is shut down.

4 Claims, 1 Drawing Sheet

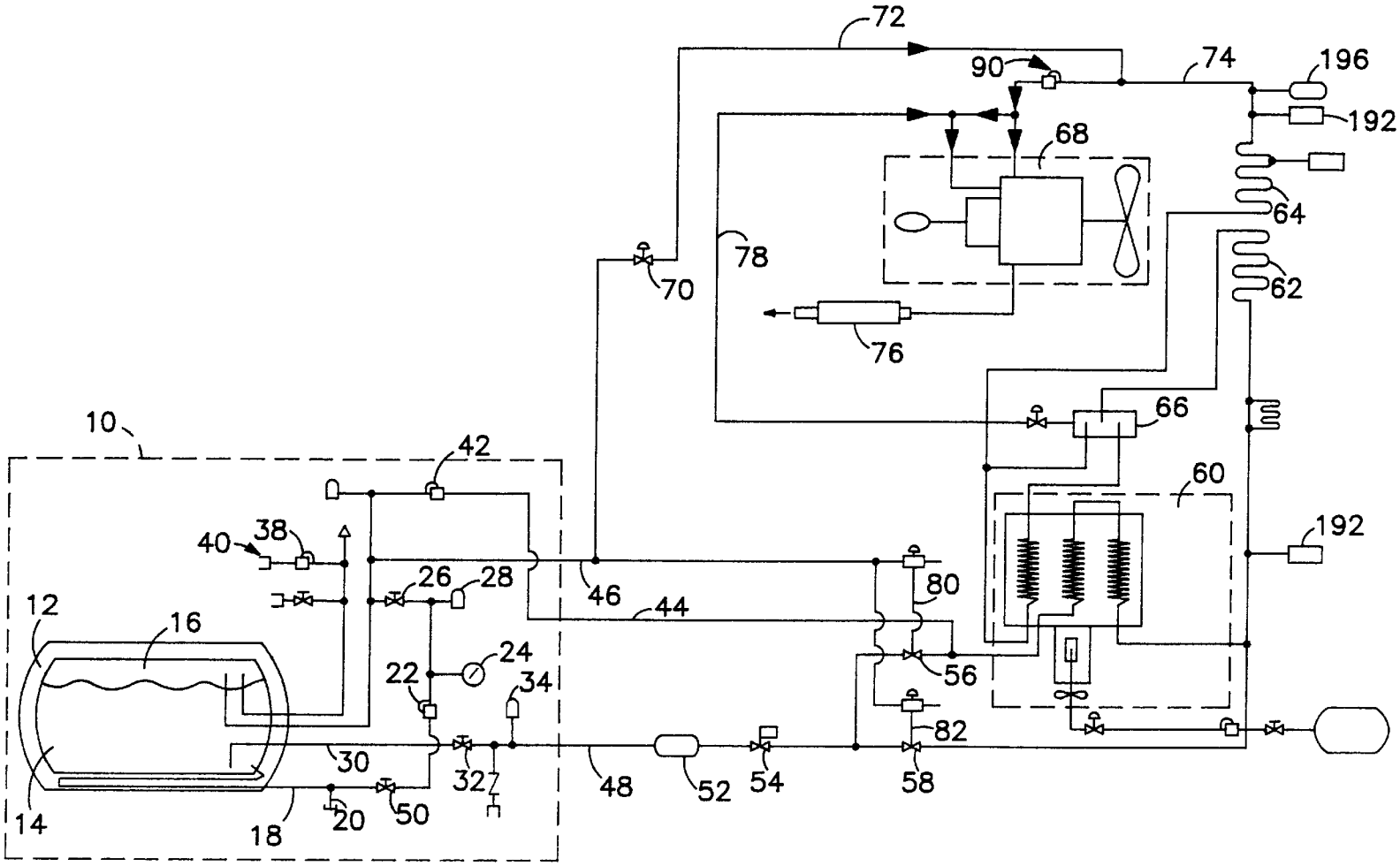
196
192
64
62
192
74
60
66
68
90
72
76
78
70
80
56
82
58
54
52
44
46
48
42
28
24
34
32
26
22
50
30
20
38
40
18
16
10
12
14

CONTROL METHOD FOR A CRYOGENIC UNIT

CROSS REFERENCE TO CO-PENDING APPLICATIONS

The present invention is related to commonly assigned U.S. patent application Ser. No. 08/501,372, filed Jul. 12, 1995, entitled AIR CONDITIONING AND REFRIGERATION UNITS UTILIZING A CRYOGEN; and to commonly assigned U.S. patent CONTROL METHOD FOR A CRYOGENIC UNIT application Ser. No. 08/560,919, filed Nov. 20, 1995, entitled APPARATUS AND METHOD FOR VAPORIZING A LIQUID CRYOGEN AND SUPERHEATING THE RESULTING VAPOR, now U.S. Pat. No. 5,598,709; both incorporated herein by reference.

BACKGROUND OF THE INVENTION

The present invention generally relates to apparatus and methods for temperature controlling a conditioned space and more particularly relates to temperature controlling systems which utilize a cryogen.

It has been known for some time to temperature condition an enclosed space for the purpose of transporting temperature sensitive materials, such as food stuffs. The most prevalent current approach is to cool and/or heat a transportable conditioned space (e.g. a refrigerated truck, trailer, or rail car) with a mechanical, condensation/evaporation system utilizing a fossil fuel powered compressor.

Unfortunately, many such mechanical systems employ refrigerants of the chlorofluorocarbon (CFC) family, because of the desirable heat of vaporization and temperature/pressure vaporization points. Certain studies have indicated that such refrigerants may produce undue deterioration of the earth's ozone layer. In response thereto, various laws and regulations have been enacted to control the release of such refrigerants to the atmosphere.

A relatively new and exciting alternative to mechanical systems utilizing CFC refrigerants is a temperature conditioning system based upon the controlled energy release from a transportable store of cryogenic liquid. In the most environmentally acceptable approaches, this involves the use of a liquified inert gas, such as nitrogen or carbon dioxide, which may be simply and harmlessly exhausted into the atmosphere at ambient temperature and pressure, after the cooling potential in its cryogenic state has been utilized to provide temperature conditioning of the controlled space.

Ideally, the entire cryogenic temperature control system is powered to the greatest extent possible by the release of the pressure stored by the cryogenic liquid with minimal or no additional energy sources. This highly integrated design promotes reliability, low cost of manufacture, and freedom from acoustic and chemical pollution.

Control valves, for example, are preferably powered by cryogenic energy rather than outside electrical or other energy sources. Similarly, attempts to provide mechanical power from the cryogenic fluid have been greatly enhanced through the use of vapor powered motors. However, such conversions of cryogenic energy to mechanical energy must be accomplished in the most efficient manner possible to prevent premature depletion of the cryogenic liquid energy source. Whereas great strides have been made concerning the design of the individual components, efficiency of cryogenic liquid energy usage is also a matter of system level design.

For example in prior art approaches, the vapor motor is powered by the vapor retrieved from the low pressure end of the evaporation coils. Whereas this is a particularly efficient method for providing ventilation to the evaporation coils during continuous operation, at system start-up there may be substantial delay in the arrival of vapor to the vapor motor thus promising clogging of the evaporation coils with dry ice and uneven evaporation.

SUMMARY OF THE INVENTION

The present invention overcomes the disadvantages found in the prior art by providing a methodology and a system which both increase the degree to which a cryogenic temperature conditioning system performs necessary functions utilizing cryogenic energy and also increase the efficiency at which the cryogenic energy is used.

In the preferred mode of the present invention, the energy stored within the cryogenic liquid is utilized in performing three system functions in addition to the basic heat absorption/release associated with temperature. The first of these functions is the powering of virtually all valves. In addition, a vapor powered ventilation blower motor is prestarted and operated by the cryogenic fluid energy. The third function is a compressed vapor take-off for powering auxiliary tools which may be needed for maintenance of the transport vehicle.

The efficiency of cryogenic energy usage is enhanced by providing valve bleeder circuits for recycling excess pressurized vapor through the vapor motor. Secondly, efficiency is further enhanced through a separate vapor input to the vapor motor directly from the storage tank. This ensures that the vapor motor starts quickly and provides ventilation to the evaporation coils immediately upon system start-up, rather than delaying until vapor is produced at the low pressure end of the evaporation coils. Elimination of this delay ensures even evaporation at system start-up and thus prevents evaporation coil clogging by uneven evaporation of cryogenic liquid.

BRIEF DESCRIPTION OF THE DRAWING

The enclosed FIGURE, being a schematic diagram, when viewed in conjunction with the following detailed description, provides an enabling disclosure of the salient features of the preferred embodiment of the present invention, without limiting the scope of the claims appended thereto.

DETAILED DESCRIPTION OF THE PREFERRED EMBODIMENT

The enclosed FIGURE provides a schematic diagram of the preferred mode of the present invention. Cryogenic tank subsystem 10 contains an insulated storage vessel 12. In the preferred mode, storage vessel 12 stores liquid carbon dioxide at a temperature of about −50 degrees F. Therefore, the overall efficiency of the system will be in large part governed by the extent to which storage vessel 12 is insulated.

During operation storage vessel 12 will contain a first volume of liquid carbon dioxide 14 and a second volume of carbon dioxide vapor 16. Of course, filling storage vessel 12 will increase first volume 14 and decrease second volume 16. Similarly, operation of the system will decrease first volume 14 and increase second volume 16.

Storage vessel 12 has two vapor outputs and two liquid outputs. A first vapor output 40 is suitable for powering standard compressed air tools via regulator 38 and standard compressed air tool fitting 40. In this manner, standard compressed air tools may be used to maintain the transport vehicle as required. The vapor output on vapor line 46 is provided as an unregulated output of cryogenic tank subsystem 10. Back pressure regulator 42 bleeds off vapor if the vapor pressure in space 16 exceeds a designed limit. Typically, this excess vapor is discharged to the atmosphere. In this invention, line 44 feeds this excess vapor to the system downstream from valves 56 and 58. This maintains the system at a slight positive pressure when the refrigeration unit is turned off. The positive pressure keeps out dirt and moisture that can back feed into the system via the open end of muffler 76.

Back pressure regulator 90 maintains,the system pressure above the triple point for carbon dioxide to prevent formation of dry ice. Thermodynamic properties of $CO_2$ are programmed into the system microprocessor (not shown). Output from pressure sensor 196 and temperature sensor 194 are compared with the programmed data to determine how close the $CO_2$ fluid is to the dry ice region. This also determines the degree to which the $CO_2$ vapor is superheated. The microprocessor responds accordingly by directing valve 54 to either open up some more or close some so as to maintain a desirable level of superheat of about 100° F. Although this is the preferred method to determine the superheat condition of the $CO_2$ vapor (you need both, the pressure and the temperature of the fluid to determine the superheat), the system can perform satisfactorily without the pressure sensor 196. The fluid pressure in coils 62, 64 and line 74 are at substantially the same pressure and this pressure can be determined by looking up the saturated pressure (from the programmed data) for the corresponding saturated temperature valve output of temperature sensor 192. The pressure value thus determined is reasonably close to the actual pressure of the fluid as would be determined by pressure sensor 196.

Main liquid output line 30 is directed through shut-off valve 32, excess pressure relief valve 34, and out of cryogenic tank subsystem 10 via liquid line 48. Line 18 is heated through the insulated wall of storage vessel 12 and is used as an internal pressure builder. Line 18 contains a drain plug 20 for cleaning and maintenance of storage vessel 12. Line 18, via shut-off valve 50, pressure regulator 22, pressure gauge 24, pressure relief valve 28 and shut-off valve 26 is used to maintain pressure within storage vessel 12 at the desired level.

The cryogenic liquid supplied by main liquid line 48 is filtered by filter 52 and flows through shut-off valve 54 before being applied to two-way valves 56 and 58 for selection of cooling or heating mode. If heating mode is selected, the cryogenic liquid is supplied by valve 56 to propane heater 60 for super heating as taught in the above referenced and incorporated co-pending applications. If cooling mode is selected, valves 58 and 66 route the cryogenic liquid through evaporation coils 62 and 64 as also described in further detail in the above referenced applications.

Also in accordance with the above referenced commonly assigned patent applications, line 74 directs vapor from the low pressure end of evaporation coils 62 and 64 to power vapor motor generator 68 before being released to the atmosphere via muffler 76. However, as is discussed above, evaporation from evaporation coils 62 and 64 tends to be uneven at system start-up, because motor generator 68 has not yet received sufficient vapor to begin rotation. Therefore, no ventilation is present at evaporation coils 62 and 64 during system start-up.

In the preferred embodiment of the present invention, carbon dioxide vapor is directed via line 46 and shut-off valve 70 to motor generator 68 via line 72 at system start-up to provide immediate ventilation. This ensures even evaporation and prevents clogging of evaporation coils 62 and 64 at system start-up.

As a further enhancement to efficiency, line 78 directs vapor leakage from valve 66 to motor generator 68 as shown.

Having thus described the preferred embodiment of the present invention in detail, those of skill in the art will readily appreciate the construction and use of yet further embodiments within the scope of the claims hereto attached.

What is claimed is:

1. A temperature conditioning system comprising: a supply vessel containing cryogenic vapor and cryogenic liquid, the cryogenic vapor having a cryogenic vapor pressure, the temperature conditioning system utilizing cryogenic liquid evaporation within an evaporation coil, the evaporation coil being ventilated by a vapor powered blower having a vapor inlet connected to receive vapor from said evaporation coil, the system comprising means interconnecting said cryogenic fluid supply and said blower vapor inlet for providing vapor to power said blower independently of said evaporation coil, the system further comprising an excess vapor line flow connecting the interior of the supply vessel to the temperature control system, the excess vapor line including a flow control valve which opens when the cryogenic vapor pressure exceeds a predetermined acceptable value to thereby permit the stored cryogenic vapor to be supplied to the system to thereby reduce the cryogenic vapor pressure to an acceptable pressure value and maintain the system at a positive pressure when the temperature conditioning system is turned off.

2. The temperature conditioning system of claim 1 wherein said interconnecting means provides vapor to said blower vapor inlet at system start-up.

3. The temperature conditioning system as claimed in claim 1, further comprising a cryogenic vapor supply line having a first inlet end located in the supply vessel cryogenic vapor and a second discharge end located outside the supply vessel and whereby cryogenic vapor is supplied to an object of interest.

4. The temperature conditioning system as claimed in claim 1, the system further comprising a first valve and a second valve flow connected to the evaporation coil, a heater flow connected to the first valve and a liquid cryogen outlet line that is flow connected to the first and second valves to selectively supply the liquid cryogen to a heater or the evaporation coil.

* * * * *